US007775294B2

(12) United States Patent
Ren et al.

(10) Patent No.: US 7,775,294 B2
(45) Date of Patent: Aug. 17, 2010

(54) PERCUSSION TOGGLE DEVICE OF A PERCUSSION DRILLER

(75) Inventors: Xi-Ren Ren, Guangdong (CN); Zhi-Wei Bai, Guangdong (CN); Ran-Ran Xia, Guangdong (CN)

(73) Assignee: Dongguan Qunsheng Powder Metallurgy Co., Ltd., Changan Town, Dongguan, Guangdong (CN)

( * ) Notice: Subject to any disclaimer, the term of this patent is extended or adjusted under 35 U.S.C. 154(b) by 78 days.

(21) Appl. No.: 12/178,555

(22) Filed: Jul. 23, 2008

(65) Prior Publication Data

US 2009/0288850 A1 Nov. 26, 2009

(30) Foreign Application Priority Data

May 20, 2008 (CN) ..... 2008 2 0048002

(51) Int. Cl.
*B25D 16/00* (2006.01)
*B25D 17/00* (2006.01)

(52) U.S. Cl. ..... 173/48; 173/90; 173/91; 173/216; 173/104; 173/217

(58) Field of Classification Search ..... 173/48, 173/90, 91, 216, 217, 104
See application file for complete search history.

(56) References Cited

U.S. PATENT DOCUMENTS 4,236,588 A * 12/1980 Moldan et al. ..... 173/48
4,428,438 A * 1/1984 Holzer ..... 173/48
4,567,950 A * 2/1986 Fushiya et al. ..... 173/48
4,763,733 A * 8/1988 Neumaier ..... 173/48
5,531,278 A * 7/1996 Lin ..... 173/176
5,842,527 A * 12/1998 Arakawa et al. ..... 173/48
6,035,945 A * 3/2000 Ichijyou et al. ..... 173/48
6,192,996 B1 * 2/2001 Sakaguchi et al. ..... 173/48
6,199,640 B1 * 3/2001 Hecht ..... 173/48
6,691,796 B1 * 2/2004 Wu ..... 173/48
7,225,884 B2 * 6/2007 Aeberhard ..... 173/93.5
7,287,600 B2 * 10/2007 Braun ..... 173/48
2004/0020668 A1 * 2/2004 Baumann et al. ..... 173/90
2005/0126801 A1 * 6/2005 Lebisch et al. ..... 173/48
2005/0199404 A1 * 9/2005 Furuta et al. ..... 173/48
2006/0086514 A1 * 4/2006 Aeberhard ..... 173/48
2009/0145617 A1 * 6/2009 Duesselberg et al. ..... 173/48

* cited by examiner

*Primary Examiner*—Brian D Nash
(74) *Attorney, Agent, or Firm*—Global IP Services; Tianhua Gu

(57) ABSTRACT

This invention discloses a percussion toggle device of a percussion driller. It includes bottom ratchet wheel that joggles the top ratchet wheel fixed in the output main shaft of the percussion driller, the locking ring used to lock the rotating direction of bottom ratchet wheel, the ejector rod to eject the locking ring, the slide rod that works with ejector rod to make it rise or fall, the percussion button connecting the slide rod, the positioning device to fixate the position of slide rod, and the reset device that works with the positioning device to remove the position limitation by the positioning device. This invention locks the rotating direction of bottom ratchet wheel through the independent percussion button, slide rod and ejector rod. In this way, the percussion toggle and the adjustment of torque force of the percussion driller can be separated. When using the percussion button, the user can toggle their operation between percussion and torque force. The user can do the toggle operation even when the motor is working. It is convenient, safe and effective.

9 Claims, 3 Drawing Sheets

PERCUSSION TOGGLE DEVICE OF A PERCUSSION DRILLER

CROSS REFERENCE TO RELATED PATENT APPLICATION

This application claims the priority of the Chinese patent application No. 200820048002.8 with a filing date of May 20, 2008, which application is incorporated herein by reference.

FIELD OF THE INVENTION

This invention touches upon the electric motion area, a percussion toggle device for the percussion driller in particular.

BACKGROUND OF THE INVENTION

In the current market, there are the conventional percussion drillers with three modes of working, which are electrical screwdriver, electric driller and percussion driller. Three working modes correspond to three function gears, which adjusts the output torque force and the toggle between different function gears. This kind of percussion driller includes the front cover of gearbox, torsion cup, output main shaft, and the upper ratchet wheel, bottom ratchet wheel, ring gear, gear set and motor that connects with the output main shaft. The torsion cup connects with the screw threads on the upper end of the gear box front cover by adjusting the net. The bottom ratchet wheel joggles with the upper ratchet wheel. There is the trip stop gasket underneath the adjustment screw and the compression spring located between the trip stop gasket and the adjustment screw. There are the steel balls between the ring gear and trip stop gasket. When the torsion cup is being turned around, the torsion cup and adjustment screw will press on the compression spring, trip stop gasket and steel balls, thus adjusting the output torque force. When it is toggled to the percussion gear, the upper ratchet wheel causes the percussion space between two ratchet wheels. The output main shaft conducts alternate motion in axial direction by the interactive forces of the upper ratchet wheel and the bottom ratchet wheel, thus realizing the percussion function.

This percussion driller often sets the percussion gear where the torsion cup is in the maximum torque gear. However, out of the considerations of safety, the percussion products out there in the market need to switch to the minimum torque force gear. When using the percussion driller, the user often needs to switch between minimum torque gear and the percussion gear. Every time the toggle angle the user turns is large and the toggle can only be carried out when the motor ceases working. It is inconvenient, unsafe and low in efficiency.

SUMMARY OF THE INVENTION

This invention aims to offer a new percussion toggle device regarding the weakness in the current technique, which can be toggled any time between the percussion gear and torsion gear.

To achieve the above objectives, the percussion toggle device in this percussion driller includes:

Bottom ratchet wheel joggles with the upper ratchet wheel fixed on the output main shaft of the percussion driller.

Locking ring, when it is set in the bottom ratchet wheel, it can limit the bottom ratchet wheel moving in the direction of peripheral direction.

Ejector rod, whose top is in contact with the locking ring, is used to eject the locking ring to cover the bottom ratchet wheel.

Slide rod works with the ejector rod to have the ejector rod rise or fall when it is moving back and forth.

Percussion button connects with the slide rod, and its rear protrudes out of the front cover of the gear box in the percussion driller.

Positioning device works with the slide rod to fixate the slide rod after the ejector rod ejects the locking ring.

Reset device works with the positioning device to remove the limitation of slide rod location by the positioning device.

There are many bumps in the outer round surface of the said bottom ratchet wheel; in the inner ring of the locking ring there are multiple necks that work with bumps.

There is the holding groove on the said slide rod, with the lower end of the ejector rod in the groove. There is a bevel that works with the bottom of ejector rod in the groove. When the ejector rod slides along the bevel, it can drive the locking ring to rise or fall.

The said positioning device includes the baffle plate and compression spring. The lower end of compression spring ejects the baffle plate. When the slide rod drives the ejector rod to rise, the baffle plate moves downward and block the slide rod by the bounce back force of the compression spring, thus fixating the slide rod.

The said reset includes the button, slide rod and offsetting spring. The rear of offsetting spring extends out of the front cover of the percussion driller's gear box, and its front end connects with the slide rod. The other end of the offsetting spring is fixed, and the other end ejects the slide board. The slide board should work with the wedge in the lower end of the baffle plate to push the baffle plate to move upward.

There is the lifting groove with opening formed in the outer side of the slide board rear. The rear of the lifting groove works with the wedge surface in the lower end of the baffle plate.

The reset button of the said reset device is next to the percussion button for the user's easy operation.

The said percussion toggle device also includes two trip stop pin rolls, which is located between the shim block and the ring gear within the percussion driller, with the positioning shaft shoulder formed in its middle. There is the positioning groove that works with the positioning shaft shoulder respectively on the percussion button and the slide plate.

This invention achieves its benefits in that it locks the rotating direction of bottom ratchet wheel through the independent percussion button, slide rod and ejector rod. In this way, the percussion toggle and the adjustment of torque force of the percussion driller can be separated. When using the percussion button, the user can toggle their operation between percussion and torque force any time. The user can do the toggle operation even when the motor is working. It is convenient, safe and effective.

DETAIL DESCRIPTION OF THE INVENTION

The following is a better execution example of the principles in this invention, thus not limited to the protective scope of this invention.

Figure 1:
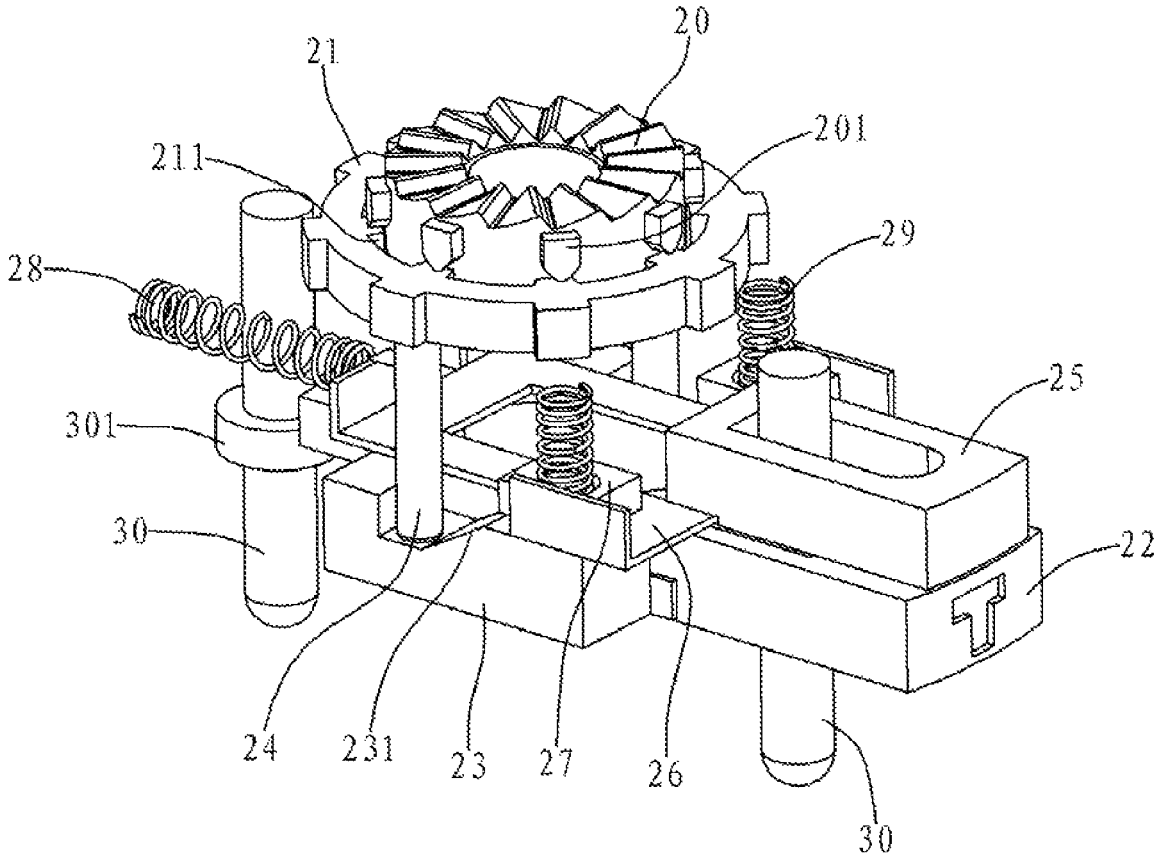
FIG. 1 is the combined structure sketch.
Figure 2:
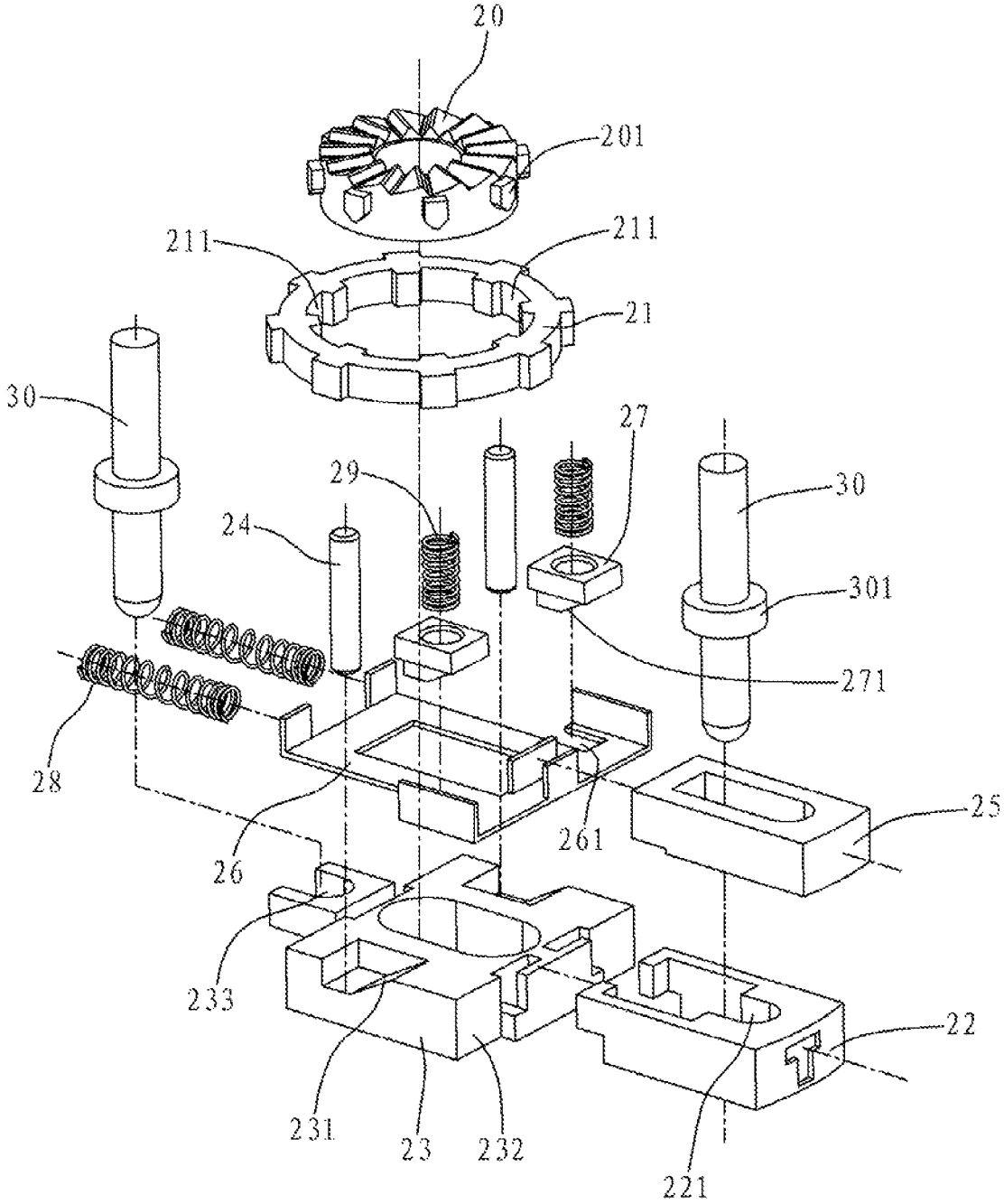
FIG. 2 is the breakdown drawing of this invention.
Figure 3:
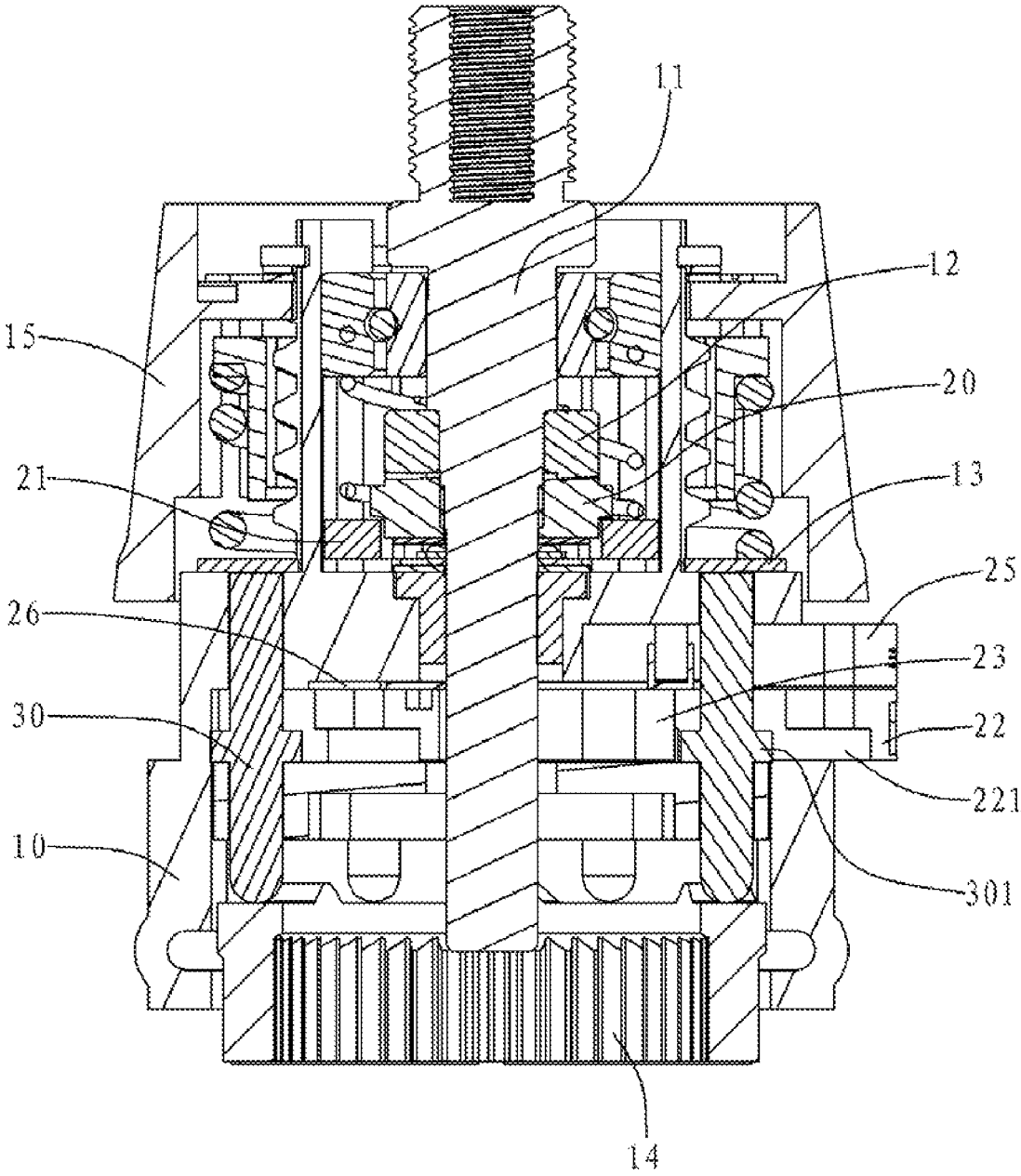
FIG. 3 is the sectional view with the percussion toggle device installed.

As shown in FIG. 1 to FIG. 3, the percussion toggle device in this percussion driller includes:

Bottom ratchet wheel 20 joggles with upper ratchet wheel 12 and there a multiple bumps 201 on its outer round surface.

Locking ring 21 that can move up and down within the front cover of the gear box of the percussion driller; there are multiple neck 211 in the inner ring of the locking ring. when it is covered in bottom ratchet wheel 20, the bump 201 of bottom ratchet wheel 20 is inserted within the neck 211, thus limiting the motion of bottom ratchet wheel in the direction of peripheral direction and allowing the output main shaft 11 of percussion driller to have alternate motion in the axial direction and achieve the function of percussion.

Two ejector rods 24 on the left and right; the top of ejector rod 24 is in contact with the bottom of locking ring 21. Locking ring 21 and ejector rod 24 rise and fall at the same time. When ejector rod 24 rises, it can eject locking ring 21 and cover bottom ratchet wheel 20.

A slide rod 23 has holding groove on both sides. The lower section of ejector rod 24 is inserted within the holding groove. The rear of the holding groove has bevel 231 that works with the bottom of ejector rod 24. When slide rod 23 moves back and forth, ejector rod 24 slides along bevel 231, thus rising or lowering.

A percussion button 22; the rear of percussion button 22 extends out of front cover 10 of gear box of percussion driller. Its front end is connected with the rear of slide rod 23. When percussion 22 is pressed down, slide rod 23 moves ahead to have ejector rod 24 drive locking ring 21 to rise and cover bottom ratchet wheel 20.

When slide rod 23 moves forward in position, it needs the positioning device that works with slide rod 23 to fixate slide rod 23. As in the execution example showed in attached pictures, the positioning device includes two baffle plates 27 and two compression spring 29. Compression spring 29 is vertically set, and its top ejects the inner wall of front cover 10 of the gear box of the percussion driller. Its lower end ejects the top of baffle plate 27. when slide rod 23 drives ejector rod 24 to rise, baffle plate 27, by the force of the bounce of compression spring 29, moves downward and gets stuck in the baffle wall 232 of the rear of slide rod 23. In this way slide rod 23 does not moves backward and fixate slide rod 23.

In addition, there is also the reset device to this invention, which works with the positioning device to relieve the limitation on slide rod 23 by the positioning device. As the execution example shown in attached pictures, the reset device includes a reset button, slide board 26 and two reset springs 28 placed horizontally. Its front is connected with the rear of slide board 26 for easy operation. It is better for reset button 25 to be set near percussion button 22, as the top of percussion button showed in the attached pictures. One end of reset spring 28 ejects the inner wall of front cover 10 of gear box of the percussion driller; the other end ejects the baffle plate at the front of slide board 26. There is lifting groove 261 with opening on the two sides at the rear of slide board 26. The rear surface of lifting groove 261 works with the wedge surface 271 at the lower section of baffle plate 27. When percussion button 22 is pressed down, slide rod 23 moves forward, and baffle plate 27 falls from lifting groove 261 and get blocked in baffle wall 232 at the rear of slide rod 23. when reset button 25 is pressed, slide rod 26 moves ahead, and the rear of lifting groove 261 drives baffle plate 27 to move upward, reliving the limitation on slide rod 23. Then, slide rod 23 moves backward and ejector rod 24 slides downward along bevel 231 and drives locking ring 21 to fall. In this way bottom ratchet wheel 20 resumes the free rotation.

Also the percussion toggle device includes two trip stop pin rollers 30, which are located between trip over gasket 13 and ring gear 14, with positioning shaft shoulder 301 in the middle. There are necks 221, 233 that work with positioning shaft shoulder 301 on percussion button 22 and slide rod 23. when percussion button 22 is pressed, it locks positioning shaft shoulder 301 with retaining nest 221 and 233 in slide rod 23 to have trip over pin roller 30 not move in the axial direction under the force of inner ring 14. It enhances the stability and reliability of the products.

The percussion driller adopts the percussion toggle device in this invention. Its torsion cup 15 rotates clockwise from the minimum gear of torsion force till the electrical driller gear. The output torsion force is rising eventually. It cannot toggle the percussion gear through rotating torsion cup 15, which can toggle the screw gear and electrical driller gear. It can only be done to toggle to percussion gear by pressing down percussion button 22.

What is claimed is:

1. A percussion toggle device of percussion driller includes:

a bottom ratchet wheel joggling with a top ratchet wheel fixated in an output main shaft of the percussion driller;

a locking ring, which limits rotation of the bottom ratchet wheel when being set in the bottom ratchet wheel;

an ejector rod whose top is in contact with the locking ring for ejecting the locking ring to cover the bottom ratchet wheel;

a slide rod working with the ejector rod to have the ejector rod rise or fall when the slide rod moves back or forth;

a percussion button connecting with the slide rod, and a rear of the percussion button protruding out of a front cover of a gear box in the percussion driller;

a positioning device working with the slide rod to fixate the slide rod after the ejector rod ejecting the locking ring;

a reset device working with the positioning device to remove the limitation of the slide rod made by the positioning device.

2. The percussion toggle device of claim 1, wherein a plurality of bumps is in an outer round surface of the bottom ratchet wheel, a plurality of necks is in an inner ring of the locking ring working with the bumps.

3. The percussion toggle device of claim 1, wherein a holding groove is on the slide rod, a lower end of the ejector rod inserts in the holding groove, a bevel of the holding groove works with the bottom of ejector rod, the ejector rod drives the locking ring to rise or fall when sliding along the bevel.

4. The percussion toggle device of claim 1, wherein the positioning device includes a baffle plate and a compression spring, the lower end of the compression spring ejects the baffle plate, when the slide rod drives the ejector rod to rise the baffle plate moves downward by the bounce back force of the compression spring and blocks the slide rod, thus the slide rod is fixed.

5. The percussion toggle device of claim 4, wherein the reset device includes a reset button, a slide board and a reset spring, the rear of the reset button extends out of the front cover of the percussion driller's gear box, and its front end connects with the slide board, one end of the offsetting spring is fixed, and other end ejects the slide board, The slide board works with the wedge in the lower end of the baffle plate to push the baffle plate to move upward.

6. The percussion toggle device of claim 5, wherein a lifting groove with opening formed in the outer side of the slide board, the rear of the lifting groove works with the wedge surface in the lower end of the baffle plate.

7. The percussion toggle device of claim 5, wherein the reset button of the reset device is next to the percussion button for easy operation.

8. The percussion toggle device of claim 1, wherein two trip stop pin rolls are located between a shim block and a ring gear within the percussion driller, each one has a positioning shaft shoulder formed in its middle, there are two positioning grooves that work with the two positioning shaft shoulders respectively on the percussion button and the slide rod.

9. The percussion toggle device of claim 5, wherein two trip stop pin rolls are located between a shim block and a ring gear within the percussion driller, each one has positioning shaft shoulder formed in its middle, there are two positioning grooves that work with the two positioning shaft shoulders respectively on the percussion button and the slide rod.

* * * * *